US006711377B2

(12) United States Patent
Yamagishi

(10) Patent No.: US 6,711,377 B2
(45) Date of Patent: Mar. 23, 2004

(54) DOUBLE-SIDED IMAGE FORMING DEVICE HAVING A TURNABLE GUIDE GUIDING A REAR END OF A LARGE-SIZE SHEET

(75) Inventor: Masaru Yamagishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/119,835

(22) Filed: Apr. 11, 2002

(65) Prior Publication Data

US 2002/0154929 A1 Oct. 24, 2002

(30) Foreign Application Priority Data

Apr. 20, 2001 (JP) ..... 2001-122710

(51) Int. Cl.[7] ..... G03G 15/00
(52) U.S. Cl. ..... 399/401; 399/110; 399/402
(58) Field of Search ..... 399/110, 124, 399/401, 402; 271/301

(56) References Cited

U.S. PATENT DOCUMENTS 5,327,206 A 7/1994 Ueda et al.
5,737,682 A 4/1998 Yamagishi
5,857,138 A * 1/1999 Iida et al. ..... 399/402
6,145,828 A * 11/2000 Arai ..... 399/124
6,279,900 B1 8/2001 Yamagishi
6,393,252 B1 5/2002 Yamagishi

FOREIGN PATENT DOCUMENTS

| | | |
|---|---|---|
| JP | 7-68012 B2 | 7/1995 |
| JP | 8-157105 | 6/1996 |
| JP | 27-24153 B2 | 11/1997 |
| JP | 11-92041 | 4/1999 |
| JP | 2002-3088 | 1/2002 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A double-sided image forming device comprises a double-side operation unit. The double-side operation unit includes a sheet reversing unit including a switchback conveying path for reversing a front side and a back side of a sheet conveyed from an image forming unit, and a reconveying path for reconveying the sheet to the image forming unit so as to form an image on the back side. The switchback conveying path has a length smaller than a length of a conveyable maximum-size sheet. The double-side operation unit can slide from/toward a body of the double-sided image forming device in a direction perpendicular to a direction of conveying the sheet. A rear end guide is further provided in the switchback conveying path so as to guide a rear end of a large-size sheet.

7 Claims, 12 Drawing Sheets

DOUBLE-SIDED IMAGE FORMING DEVICE HAVING A TURNABLE GUIDE GUIDING A REAR END OF A LARGE-SIZE SHEET

BACKGROUND OF THE INVENTION

1. Field of the Invention

The present invention generally relates to a double-sided image forming device, and more particularly, to a double-sided image forming device, such as a copying machine, a printer, or a facsimile apparatus, having a double-side operation unit that forms an image on a sheet fed thereto, and reverses the sheet so as to cause an image to be formed on a reverse side.

2. Description of the Related Art

To begin with, a description will be given of a sheet conveying operation of a double-side operation unit included in a conventional double-sided image forming device.

FIG. 1 is an illustration outlining the double-side operation unit included in the conventional double-sided image forming device. As shown in FIG. 1, a sheet having an image formed on one side enters from a fixing unit of an image forming unit provided in a body of the image forming device into a sheet reversing unit of the double-side operation unit. The sheet is temporarily contained in a switchback conveying path 2 via a reversibly rotatable switchback roller 1. Then, the switchback roller 1 rotates reversely so as to send the sheet to a reverse roller 3. The reverse roller 3 turns the sheet by 180° toward a horizontal conveying path (a reconveying path) 5 provided underneath. The horizontal conveying path 5 comprises a plurality of horizontal conveying rollers 4 arranged at intervals corresponding to a length of a minimum-size sheet, and transfers the sheet to a relay roller 6 provided further downstream. Then, the sheet returns to the image forming unit provided in the body of the image forming device so that an image is formed on the other side of the sheet.

Next, a description will be given of an operation of conveying a maximum-size sheet. FIG. 2A and FIG. 2B are illustrations explaining the operation of conveying a maximum-size sheet in a conventional double-side operation unit.

In the double-side operation unit shown in FIG. 2A, the switchback conveying path 2 has a length L smaller than a length $L_{Pmax}$ of the maximum-size sheet so that the body of the image forming device occupies little space. Upon conveying the maximum-size sheet in the double-side operation unit, a rib 7 is provided as shown in FIG. 2B so as to bring a rear end of the sheet to a refuge space upward.

However, drawing out the double-side operation unit in a direction perpendicular to the direction in which the sheet is conveyed (i.e., toward the foreground of FIG. 2B), requires a space 8 occupied by the double-side operation unit as indicated by a dashed line in FIG. 2B, which is a drawback for the body of the image forming device to occupy little space (to be thinned down).

SUMMARY OF THE INVENTION

It is a general object of the present invention to provide an improved and useful double-sided image forming device in which the above-mentioned problems are eliminated.

A more specific object of the present invention is to provide a double-sided image forming device which can minimize a space occupied by a double-side operation unit by adopting simple structures so that the double-sided image forming device occupies little space (is thinned down).

In order to achieve the above-mentioned objects, there is provided according to the present invention a double-sided image forming device comprising a double-side operation unit including a switchback conveying path having a length smaller than a length of a maximum-size sheet, and a movable rear end guide guiding a rear end of a large-size sheet.

According to the present invention, a space occupied by the double-side operation unit upon being drawn out from a body of the double-sided image forming device can be reduced. Consequently, the double-sided image forming device occupies little space.

Additionally, the rear end guide is turnable in accordance with a drawing and a setting of the double-side operation unit. A turning angle of the rear end guide is determined by a positioning member provided on a board of the body of the double-sided image forming device and a stopper provided on a side surface of the double-side operation unit. This simple arrangement enables the double-sided image forming device to occupy little space.

Further, the turning angle of the rear end guide can be varied continuously by indefinite steps by mounting a dial member on a turning axle of the rear end guide and providing a conical stopper on the side surface of the double-side operation unit. The present arrangement eliminates variations in dimensional tolerances of components composing the double-sided image forming device so as to realize an optimal sheet conveyance in the double-sided image forming device.

Other objects, features and advantages of the present invention will become more apparent from the following detailed description when read in conjunction with the accompanying drawings.

BRIEF DESCRIPTION OF THE DRAWINGS

FIG. 7B is mounted;

DETAILED DESCRIPTION OF THE PREFERRED EMBODIMENTS

A description will now be given, with reference to the drawings, of embodiments according to the present invention.

Figure 1:
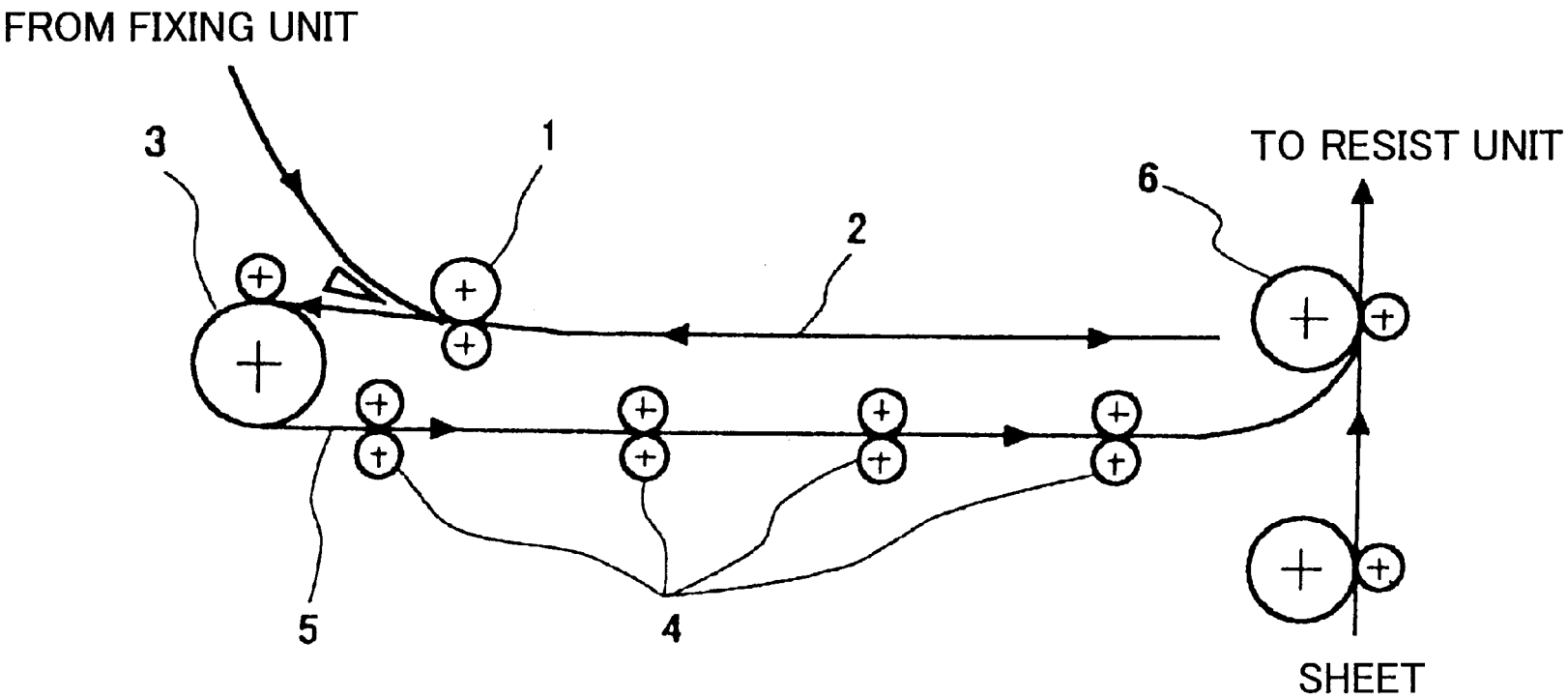
FIG.1 PRIOR ART
FIG. 1 is an illustration outlining a double-side operation unit included in a conventional double-sided image forming device.
Figure 3:
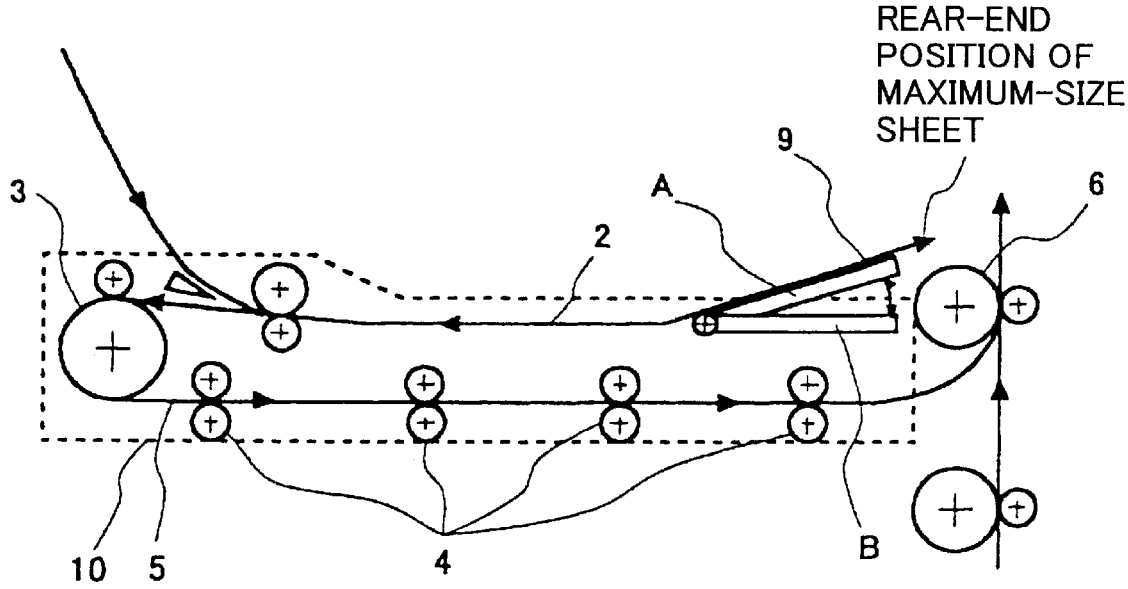
FIG. 3 is an illustration outlining a double-side operation unit included in a double-sided image forming device according to the present invention.

FIG. 3 is an illustration outlining a double-side operation unit included in a double-sided image forming device according to the present invention. As shown in FIG. 3, the double-side operation unit according to the present invention comprises the switchback roller 1, the switchback conveying path 2, the reverse roller 3, the horizontal conveying rollers 4, the horizontal conveying path 5, and the relay roller 6, as does the conventional double-side operation unit shown in FIG. 1. Also, the double-side operation unit according to the present invention performs the same sheet conveying operation as does the conventional double-side operation unit. Also, the switchback conveying path 2 has the length L smaller than the length $L_{Pmax}$ of the maximum-size sheet.

Figure 2A:
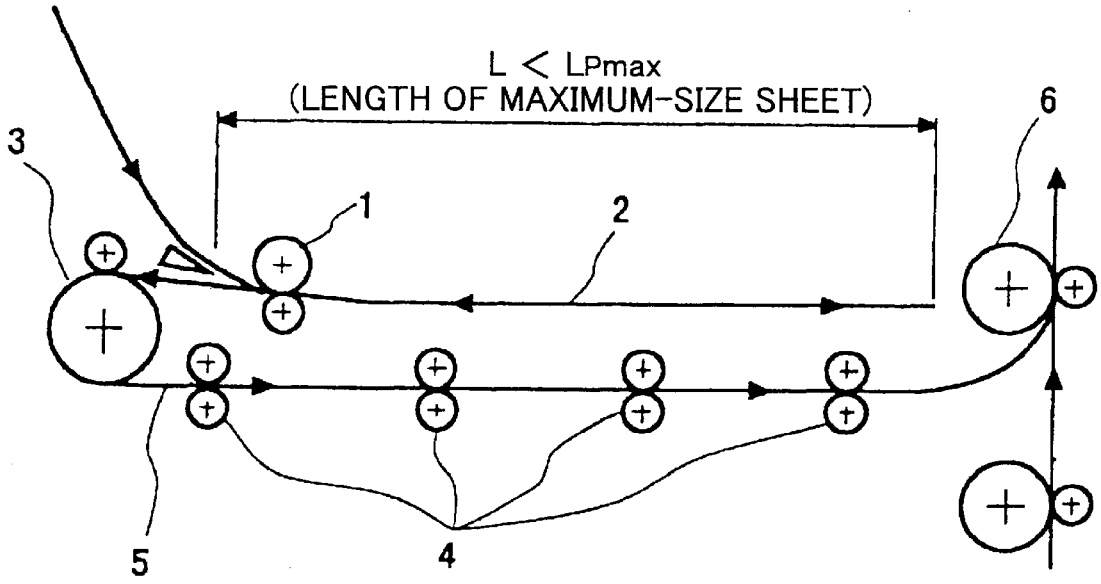
FIG.2A PRIOR ART
FIG. 2A and FIG. 2B are illustrations explaining an operation of conveying a maximum-size sheet in a conventional double-side operation unit.
Figure 2B:
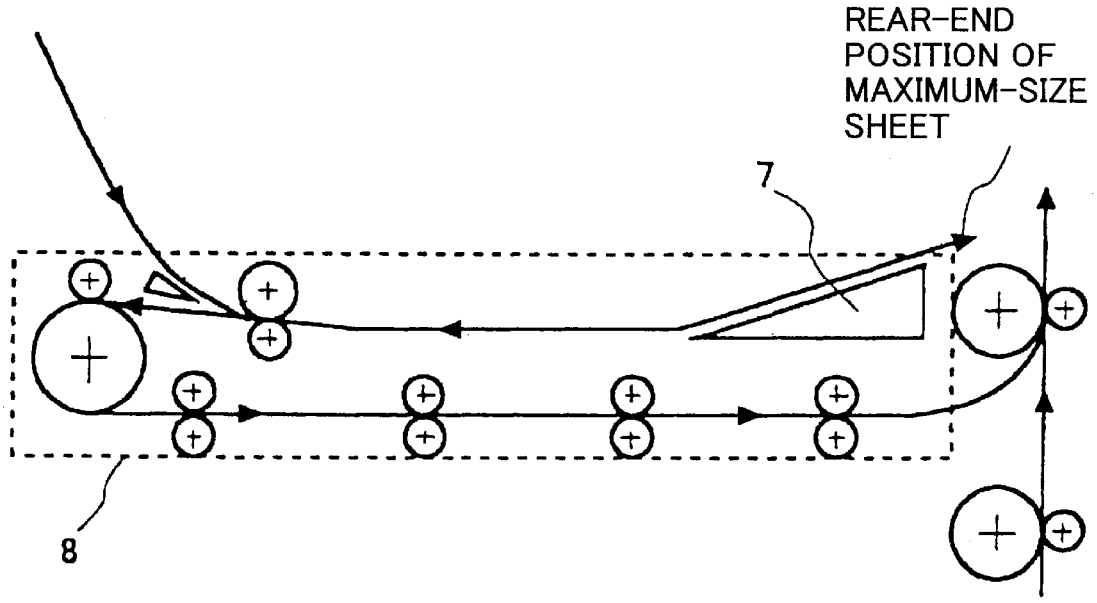
FIG.2B PRIOR ART

The double-side operation unit according to the present invention comprises a movable rear end guide 9 as means for bringing the maximum-size sheet to a refuge space beyond the switchback conveying path 2, in place of the rib 7 provided in the conventional double-side operation unit shown in FIG. 2B. The rear end guide 9 springs up to a position A upon setting the double-side operation unit, and withdraws to a position B upon drawing out the double-side operation unit in a direction perpendicular to the direction in which the sheet is conveyed (i.e., toward the foreground of FIG. 3). Accordingly, drawing out the double-side operation unit according to the present invention only requires a space 10 occupied by the double-side operation unit as indicated by a dashed line in FIG. 3, the space 10 being smaller than the space 8 occupied by the conventional double-side operation unit shown in FIG. 2B. Consequently, this structure reduces a space occupied by a body of the image forming device.

The rear end guide 9 is turnable in accordance with the drawing and the setting of the double-side operation unit. Mechanisms for turning the rear end guide 9 include a mechanism using a solenoid to detect the setting of the double-side operation unit and turn the rear end guide 9 in accordance with the setting.

Next, a description will be given of other mechanisms for turning the rear end guide 9.

Figure 4A:
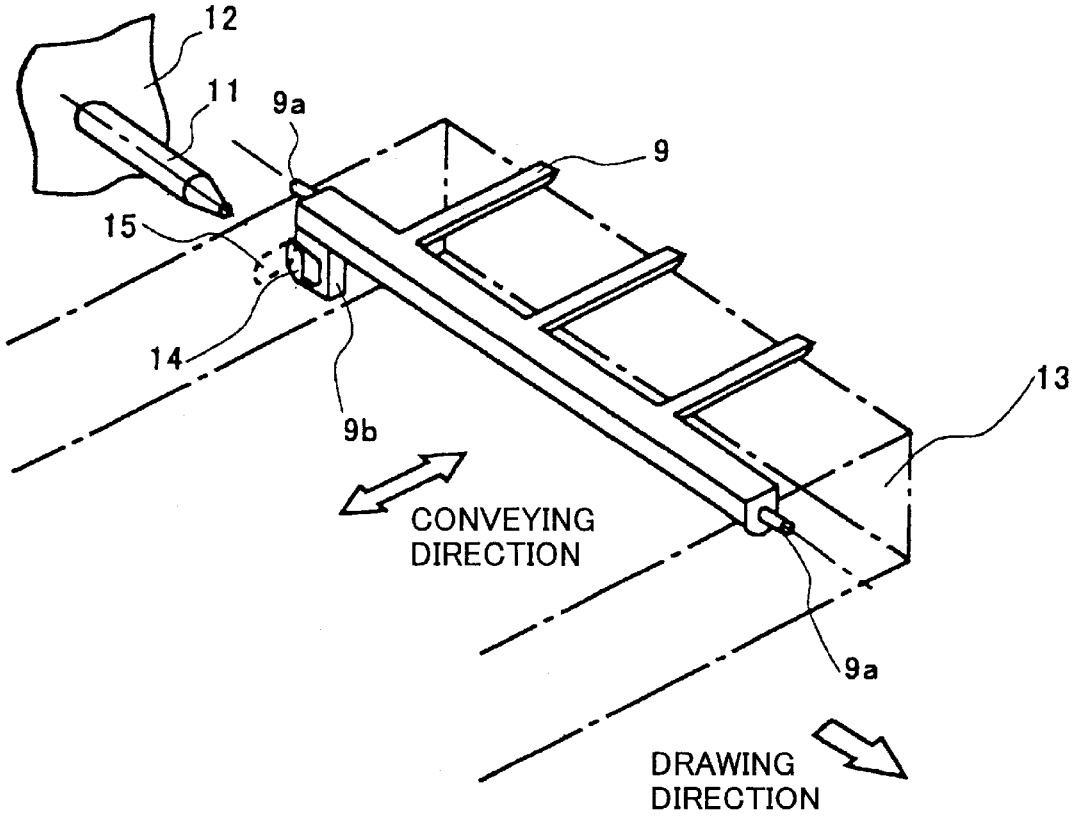
FIG. 4A is an illustration of an operation of a rear end guide shown in FIG. 3 upon drawing out the double-side operation unit.
Figure 4B:
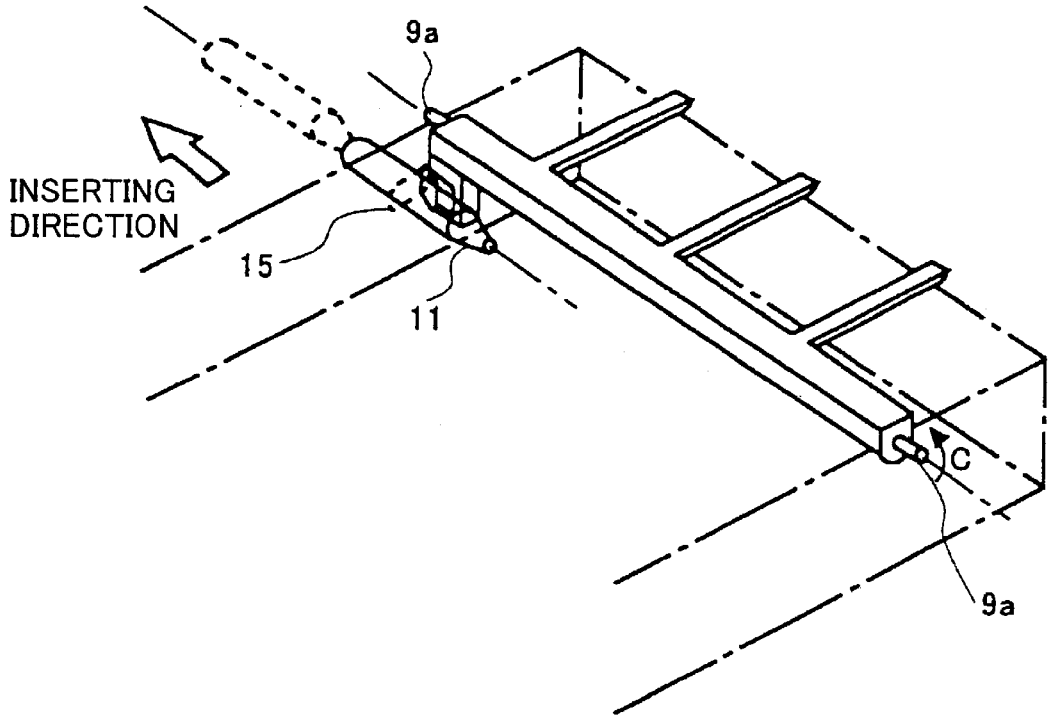
FIG. 4B is an illustration of an operation of the rear end guide upon setting the double-side operation unit.

FIG. 4A is an illustration of an operation of the rear end guide 9 upon drawing out the double-side operation unit. FIG. 4B is an illustration of an operation of the rear end guide 9 upon setting (inserting) the double-side operation unit.

The rear end guide 9 is provided on a double-side operation unit 13, with a turning axle 9*a* functioning as a fulcrum. Additionally, a projection 9*b* is provided on the rear end guide 9. The projection 9*b* comprises an elastic member 14, such as a plate spring.

A positioning member 11 is provided on a board 12 of the body of the double-sided image forming device so as to position the double-side operation unit 13 in a vertical direction. The rear end guide 9 is turned by the positioning member 11 contacting the elastic member 14. Upon setting the double-side operation unit 13, the positioning member 11 is inserted into a long hole 15 formed in a side surface of the double-side operation unit 13, and contacts the elastic member 14 so as to turn the rear end guide 9 in a direction indicated by an arrow C, as shown in FIG. 4B. Upon drawing out the double-side operation unit 13, the elastic member 14 returns to an original position thereof so that the rear end guide 9 falls down, as shown in FIG. 4A.

A turning angle of the rear end guide 9 is set as follows.

Figure 5:
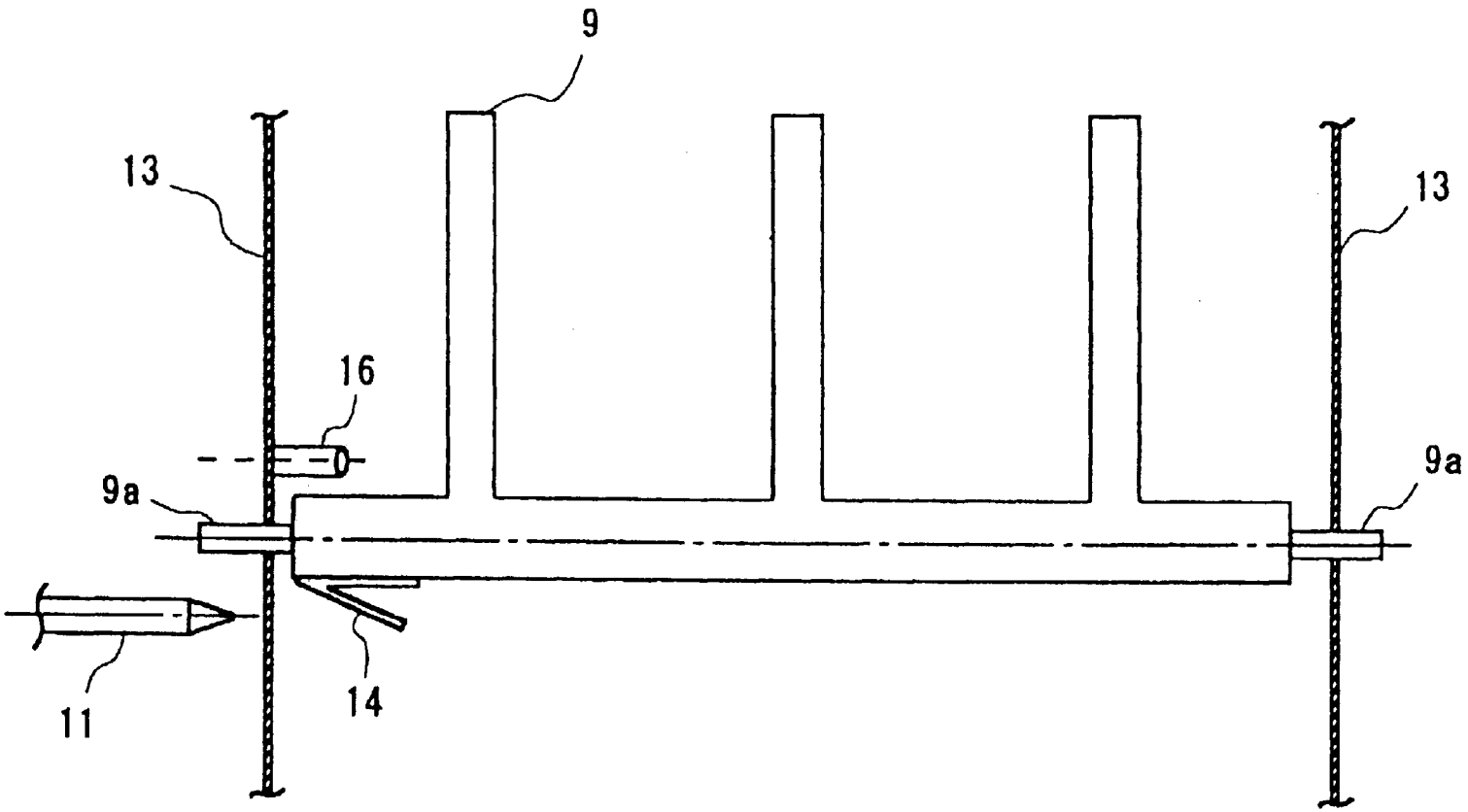
FIG. 5 is a plan view of the double-side operation unit shown in FIG. 4A and FIG. 4B.
Figure 6A:
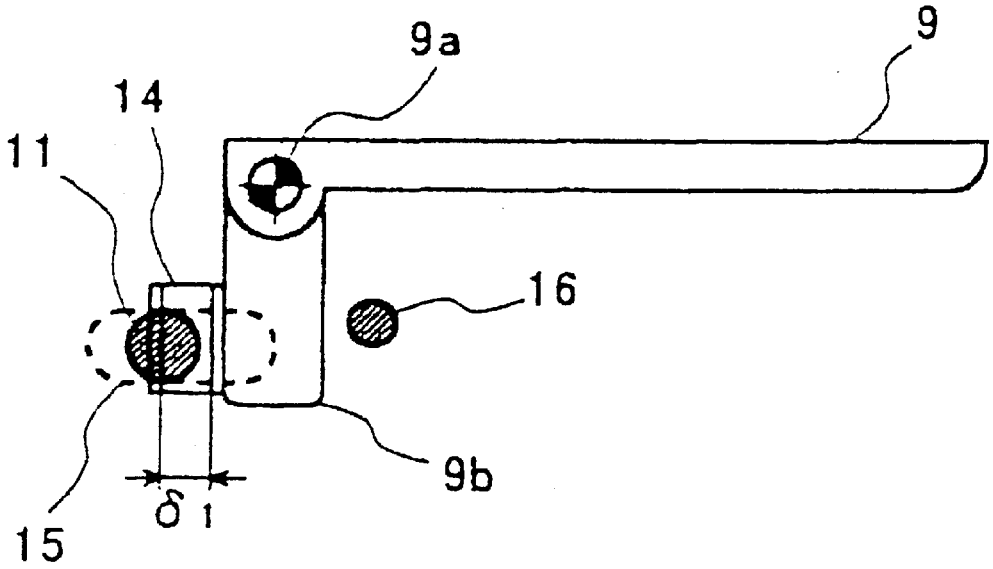
FIG. 6A is a sectional view illustrating an operation of the rear end guide upon drawing out the double-side operation unit.
Figure 6B:
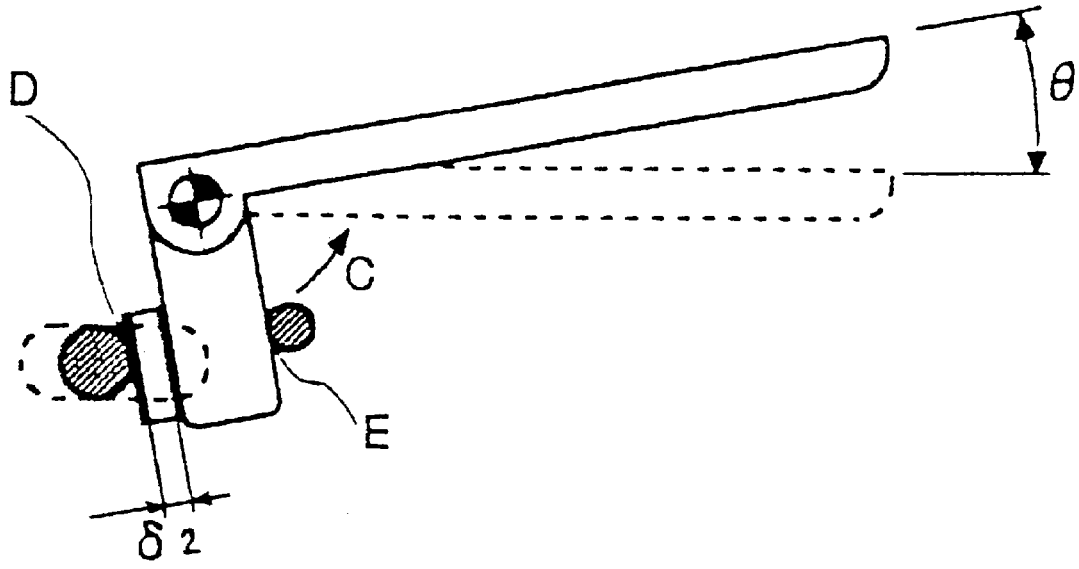
FIG. 6B is a sectional view illustrating an operation of the rear end guide upon setting the double-side operation unit.

FIG. 5 is a plan view of the double-side operation unit shown in FIG. 4A and FIG. 4B. FIG. 6A is a sectional view illustrating the operation of the rear end guide 9 upon drawing out the double-side operation unit. FIG. 6B is a sectional view illustrating the operation of the rear end guide 9 upon setting the double-side operation unit.

A turning angle θ of the rear end guide 9 in the direction indicated by the arrow C is set by a stopper 16. As shown in FIG. 6B, the positioning member 11 and the elastic member 14 contact each other at a point D. The rear end guide 9 turns so that the projection 9*b* contacts the stopper 16 at a point E so as to position the rear end guide 9. In this course, the elastic member 14 elastically shrinks by (δ1−δ2) so as to enable a sure contact of the projection 9*b* and the stopper 16 at the point E. Additionally, the elastic shrinkage of the elastic member 14 compensates variations in dimensional tolerances of the heretofore-mentioned components so as to secure an accuracy of the turning angle θ of the rear end guide 9.

Additionally, the turning angle θ of the rear end guide 9 can be made variable by the following arrangement.

Figure 7A:
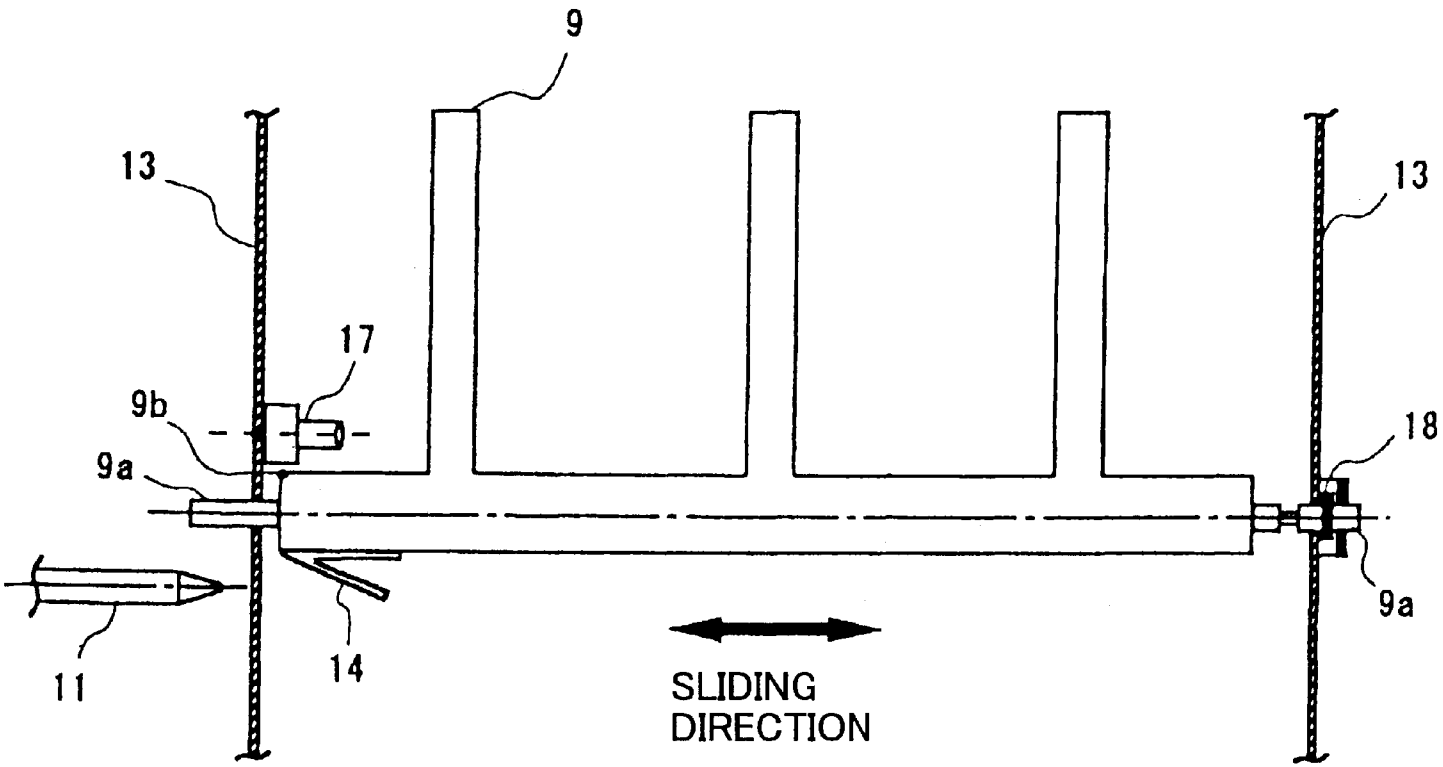
FIG. 7A is a plan view of the double-side operation unit in which a turning angle θ of the rear end guide is varied to a turning angle θ1.
Figure 7B:
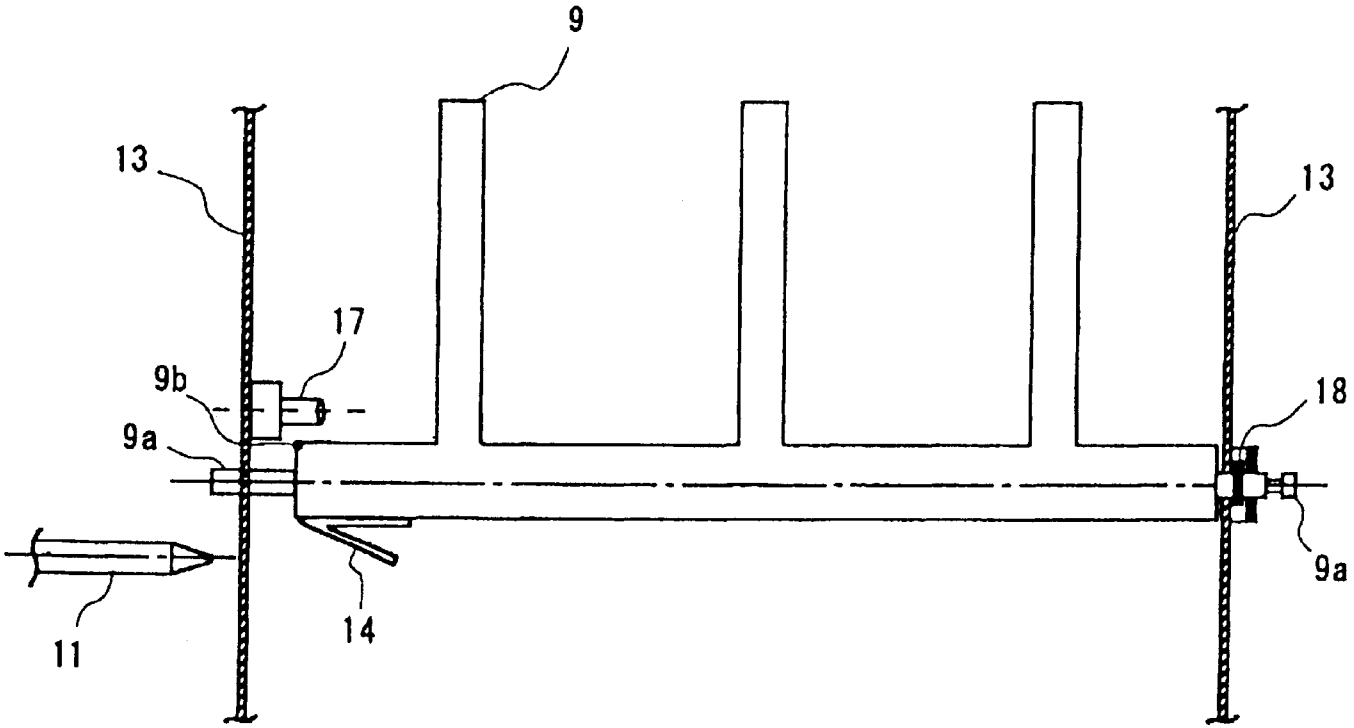
FIG. 7B is a plan view of the double-side operation unit in which the turning angle θ of the rear end guide is varied to a turning angle θ2.
Figure 8A:
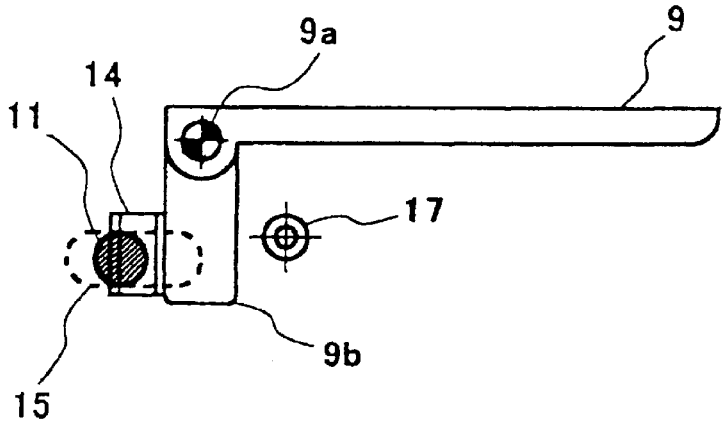
FIG. 8A is a sectional view of the rear end guide upon drawing out the double-side operation unit.
Figure 8B:
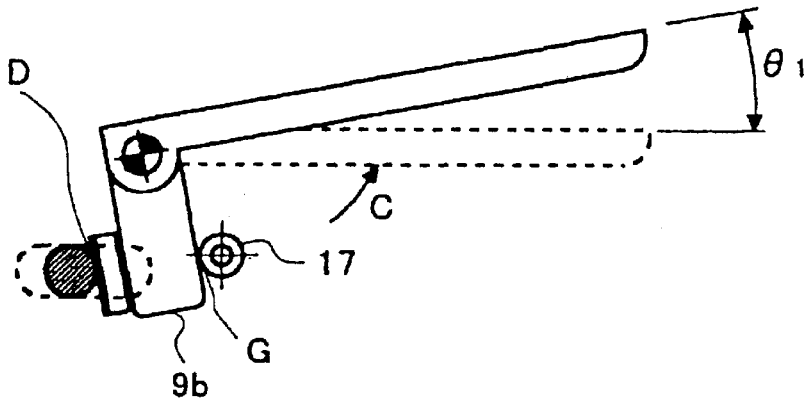
FIG. 8B is a sectional view of the rear end guide upon setting the turning angle θ1.
Figure 8C:
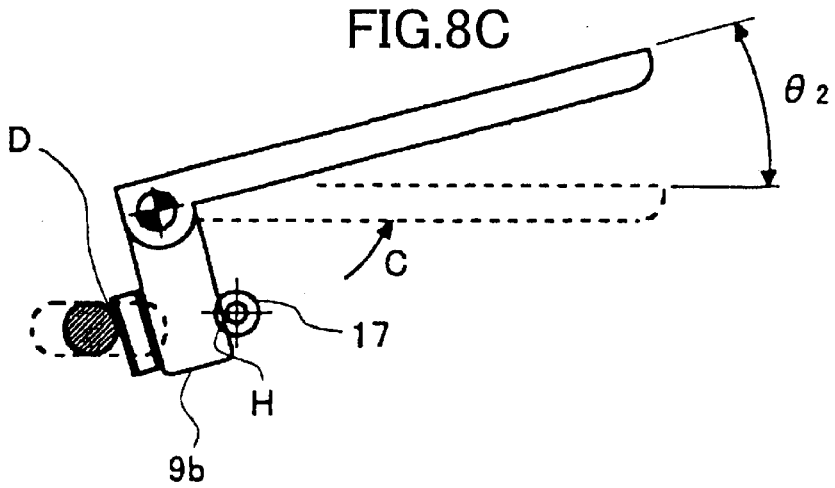
FIG. 8C is a sectional view of the rear end guide upon setting the turning angle θ2.

FIG. 7A and FIG. 7B are plan views of the double-side operation unit in which the turning angle θ of the rear end guide 9 is variable. Specifically, FIG. 7A illustrates a position of the rear end guide 9 upon setting a turning angle θ1. FIG. 7B illustrates a position of the rear end guide 9 upon setting a turning angle θ2. FIG. 8A is a sectional view of the rear end guide 9 upon drawing out the double-side operation unit. FIG. 8B is a sectional view of the rear end guide 9 upon setting the turning angle θ1. FIG. 8C is a sectional view of the rear end guide 9 upon setting the turning angle θ2.

In the present arrangement, the rear end guide 9 can slide in directions indicated by a double-pointed arrow shown in FIG. 7*k*. Additionally, two grooves are formed in the turning axle 9*a* at an end portion (right in FIG. 7A and FIG. 7B) opposite to an end where the positioning member 11 contacts the elastic member 14. Further, a stepped stopper 17 composed of two steps of cylindrical projections is provided on the side surface of the double-side operation unit 13 in place of the stopper 16. In this arrangement, the number of the grooves formed in the turning axle 9*a* and the number of the steps composing the stepped stopper 17 are not limited to two, but may be more than two.

In FIG. 7A, the rear end guide 9 is arranged at such a position that the projection 9*b* contacts the larger-diameter cylindrical projection of the stepped stopper 17. A positioning of the rear end guide 9 in the sliding directions thereof is performed by inserting a stopping ring 18 into the outer groove formed in the turning axle 9*a*.

Figure 9:
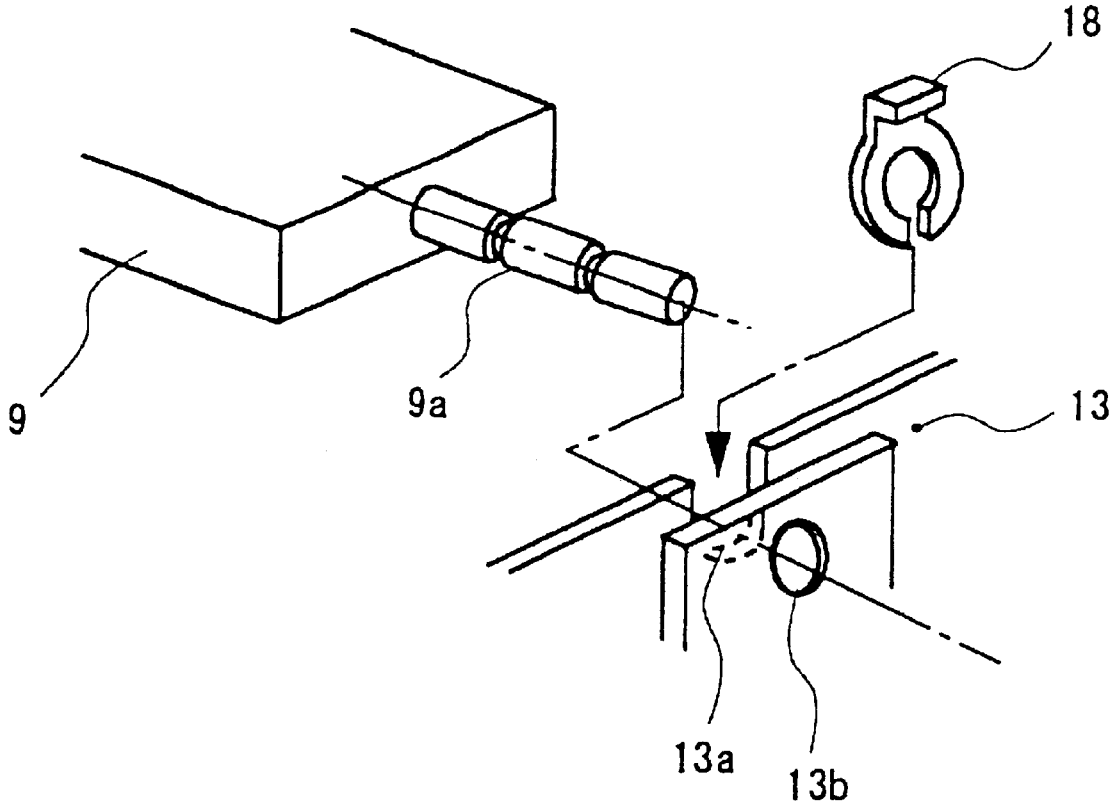
FIG. 9 is an illustration showing details of a part where a stopping ring shown in FIG. 7A

FIG. 9 is an illustration showing details of a part where the stopping ring 18 is mounted. An axle bearing 13*a* formed in the other side surface of the double-side operation unit 13 accepts the outer groove formed in the turning axle 9*a* passed through and supported on a hole 13*b* of a supporting board. The stopping ring 18 is fit into the axle bearing 13*a* so as to fix the turning axle 9*a*. In this state, a turning of the rear end guide 9 is stopped at a point G such that the turning angle becomes θ1, as shown in FIG. 8B.

In FIG. 7B, the rear end guide 9 is slid toward right (in the figure) to such a position that the projection 9*b* contacts the smaller-diameter cylindrical projection of the stepped stopper 17. The axle bearing 13*a* accepts the inner groove formed in the turning axle 9*a*, and the stopping ring 18 is fit into the axle bearing 13*a* so as to fix the turning axle 9*a*. In this state, a turning of the rear end guide 9 is stopped at a point H such that the turning angle becomes θ2, as shown in FIG. 8C.

The above-described arrangement enables the turning angle θ of the rear end guide 9 to be varied arbitrarily with ease. Accordingly, the present arrangement can secure a stacking space for a still larger-size sheet, and also can secure an allowance for a curling paper, according to requirements on each occasion. Consequently, the present arrangement increases a general-purpose property of the double-side operation unit 13 per se.

Further, the following arrangement enables the turning angle θ of the rear end guide 9 to be varied continuously by indefinite steps.

Figure 10:
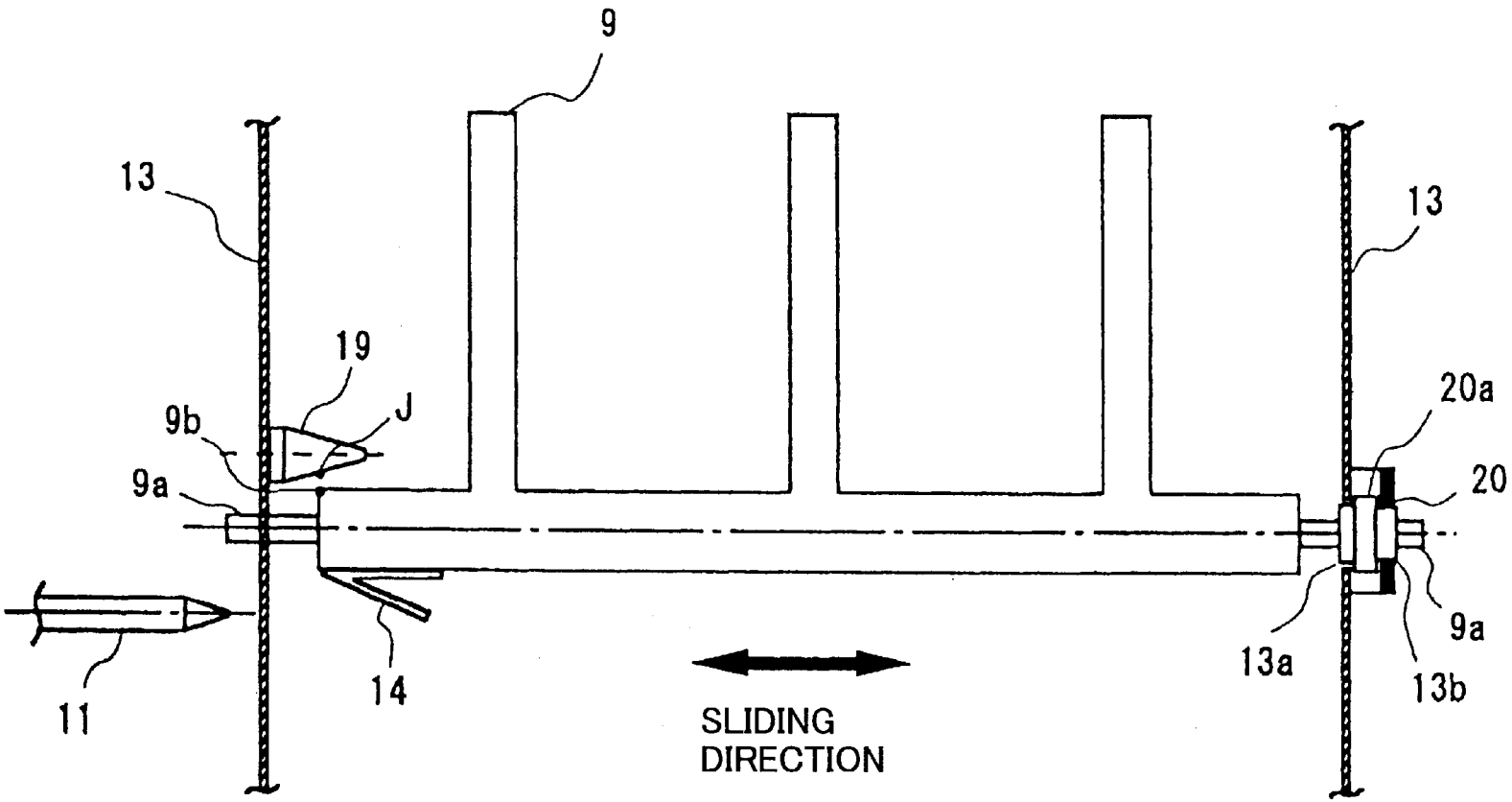
FIG. 10 is a plan view of the double-side operation unit in which the turning angle θ of the rear end guide can be varied continuously by indefinite steps.

FIG. 10 is a plan view of the double-side operation unit in which the turning angle θ of the rear end guide 9 can be varied continuously by indefinite steps. The rear end guide 9 can slide in directions indicated by a double-pointed arrow shown in FIG. 10. A positioning of the rear end guide 9 in the sliding directions thereof is performed by a dial member 20 mounted on the turning axle 9*a* at an end (right in FIG. 7A and FIG. 7B) opposite to an end where the positioning member 11 contacts the elastic member 14.

Figure 11:
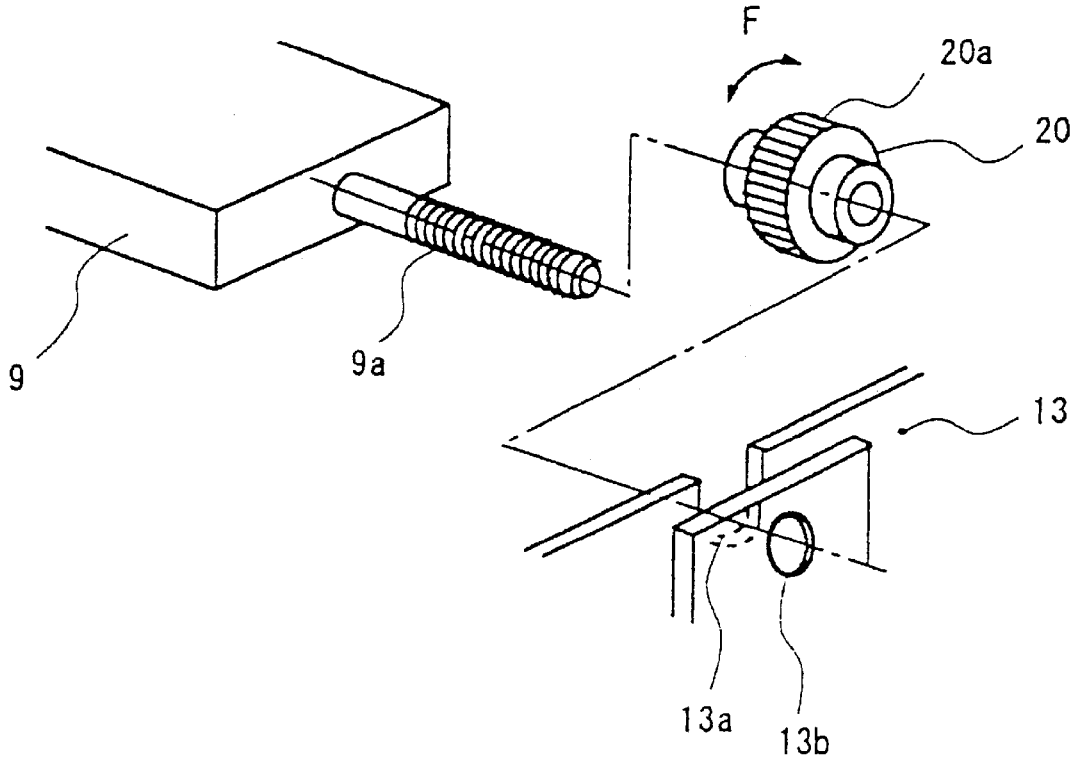
FIG. 11 is an illustration showing details of a part where a dial member shown in FIG. 10 is mounted on a turning axle shown in FIG. 10.

FIG. 11 is an illustration showing details of a part where the dial member 20 is mounted on the turning axle 9*a*. A male screw is formed on the turning axle 9*a*, and a female screw is formed in a through hole of the dial member 20, so as to together form a screw structure fixing the turning axle 9*a* borne by the axle bearing 13*a*. Additionally, an outer peripheral surface 20*a* of the dial member 20 has a nonskid form such as grooves. Accordingly, the rear end guide 9 can slide continuously by indefinite steps in accordance with revolutions of the dial member 20 in directions indicated by a double-pointed arrow F.

A conical stopper 19 composed of a conical projection is provided on the side surface of the double-side operation unit 13 in place of the stepped stopper 17. In the present arrangement, a contact point J between the projection 9*b* of the rear end guide 9 and the conical stopper 19 can be shifted continuously by indefinite steps in accordance with above-described indefinite-step slide of the rear end guide 9. Accordingly, the turning angle θ of the rear end guide 9 can be adjusted finely by indefinite steps. Therefore, this arrangement enables an adjustment of varying angles resulting from variations in dimensional tolerances of the heretofore-mentioned components so as to realize an optimal sheet conveyance.

The present invention is not limited to the specifically disclosed embodiments, and variations and modifications may be made without departing from the scope of the present invention.

The present application is based on Japanese priority application No. 2001-122170 filed on Apr. 20, 2001, the entire contents of which are hereby incorporated by reference.

What is claimed is:

1. A double-sided image forming device comprising a double-side operation unit capable of sliding in relation to a body of said double-sided image forming device in a direction perpendicular to a direction of conveying a sheet, the double-side operation unit including:

a sheet reversing unit including a switchback conveying path for reversing a front side and a back side of the sheet conveyed from an image forming unit provided in said body, the switchback conveying path having a length smaller than a length of a conveyable maximum-size sheet;

a reconveying path for reconveying said sheet to said image forming unit so as to form an image on said back side; and a rear end guide provided in said switchback conveying path and configured to turn toward an upward position so as to guide a rear end of a large-size sheet in the upward position.

2. The double-sided image forming device as claimed in claim 1, wherein said rear end guide is turned in accordance with a detachment and an insertion of said double-side operation unit from and to said body.

3. The double-sided image forming device as claimed in claim 2, wherein said rear end guide is turned by a positioning member provided on said body, while said double-side operation unit is positioned by said positioning member.

4. The double-sided image forming device as claimed in claim 3, wherein said rear end guide contacts said positioning member via an elastic member provided in a projecting portion formed on said rear end guide.

5. The double-sided image forming device as claimed in claim 4, wherein a turning angle of said rear end guide is determined by a stopper provided on a side surface of said double-side operation unit.

6. The double-sided image forming device as claimed in claim 5, wherein said rear end guide is capable of sliding in a direction parallel to a turning axle thereof, and said stopper is provided with a plurality of steps, and a plurality of grooves are formed in said turning axle so as to determine the turning angle of said rear end guide.

7. The double-sided image forming device as claimed in claim 5, wherein said rear end guide is slid in a direction parallel to a turning axle thereof by a screw structure composed of said turning axle and a dial member, and said stopper is formed as a conical projection so as to vary the turning angle of said rear end guide continuously by indefinite steps.

* * * * *

UNITED STATES PATENT AND TRADEMARK OFFICE

CERTIFICATE OF CORRECTION

PATENT NO. : 6,711,377 B2
DATED : March 23, 2004
INVENTOR(S) : Yamagishi

It is certified that error appears in the above-identified patent and that said Letters Patent is hereby corrected as shown below:

Title page,
Item [30], Foreign Application Priority Data, should read:

-- [30] Foreign Application Priority Data

Apr. 20, 2001 (JP) …….. 2001-122170 --

Signed and Sealed this

Twenty-second Day of June, 2004

JON W. DUDAS
*Acting Director of the United States Patent and Trademark Office*